United States Patent [19]

Hofmann

[11] Patent Number: 4,460,127

[45] Date of Patent: Jul. 17, 1984

[54] DEVICE FOR APPLYING UNIFORM TRAFFIC LINES

[75] Inventor: Walter Hofmann, Hamburg, Fed. Rep. of Germany

[73] Assignee: Walter Hofmann Maschinenfabrik, Rellingen, Fed. Rep. of Germany

[21] Appl. No.: 274,029

[22] Filed: Jun. 15, 1981

[30] Foreign Application Priority Data

Jun. 14, 1980 [DE] Fed. Rep. of Germany ..... 3022448

[51] Int. Cl.[3] ..... B05B 12/08

[52] U.S. Cl. ..... 239/126; 239/127; 239/155

[58] Field of Search ..... 239/126, 124, 127, 172, 239/150, 155, 151, 125

[56] References Cited

U.S. PATENT DOCUMENTS

| | | | |
|---|---|---|---|
| 3,083,913 | 4/1963 | Coffman et al. | 239/150 |
| 3,322,134 | 5/1967 | Enemark | 239/126 X |
| 3,589,610 | 6/1971 | Wahlin et al. | 239/125 |
| 3,820,718 | 6/1974 | Ammon | 239/172 |

FOREIGN PATENT DOCUMENTS

| | | | |
|---|---|---|---|
| 966202 | 7/1949 | Fed. Rep. of Germany | 239/125 |

*Primary Examiner*—John J. Love

*Attorney, Agent, or Firm*—Collard, Roe & Galgano

[57] ABSTRACT

A device for obtaining a uniform application of marking material on streets, squares, or the like and, in particular, a marking machine with travel dependent driven, statically-operating pump system for the marking material, is provided. The device prevents the occurrence of substantial pressure fluctuations with respect to the given system pressure during opening and closing of an applicator nozzle and serves to influence the feeding flow to the nozzle.

2 Claims, 3 Drawing Figures

DEVICE FOR APPLYING UNIFORM TRAFFIC LINES

The invention relates to a device for uniformly applying marking materials on streets, squares, or the like. More particularly, it relates to marking machines having a travel speed dependent-driven, statically-operating pump system for the marking material.

Traffic markings are produced to a great extent with the assistance of so-called "road marking machines" which apply the liquid marking materials, in particular paints, under pressure from applicator nozzles of different designs, preferably jet nozzles, onto the road surface.

In most of the known road marking machines, the jet nozzle is fed in a simple manner from a pressure activated supply container. In another known system, the jet nozzle is fed from a constantly flowing paint flow which is generated by a pump which sucks the paint from a pressureless supply container. The pump returns the superfluous or remaining paint which is not used up by the nozzle through an adjustable excess pressure valve, which maintains the desired excess pressure in the paint system, and back into the suction line or into the supply container.

When the nozzle is closed, the original excess pressure of the paint system propagates as a static pressure in the paint line to the nozzle, whereby due to elasticities, an expansion of the line with an enlargement or increase of the paint content occurs. When opening the nozzle, a lower pressure occurs in the line due to the initiation of flow, whereby the elastic expansion in the paint line relaxes or contracts which results in an increased paint discharge from the nozzle for a short period and thereby to an increased paint accumulation at the beginning of a traffic marker section. Since with an increased layer thickness, the drying time of the paint increases overproportionally, such paint accumulations are extremely disadvantageous for the total drying time of a newly applied traffic marker. This is so because the total drying time for driving over a traffic marker is defined by the longest existing drying time. The new traffic marker must be protected against traffic until the locations with the larger layer thickness may also be travelled over. It is obvious that traffic markers with such paint accumulations cause considerable difficulties in the marking operation.

In the aforementioned known road marking machines, the increased paint throughflow occurring through the nozzle and, in turn, the paint accumulation at the start of the traffic marker segment, can be reduced to a minimum when using suitable paint conduits having a sufficiently large cross section and a low radial elasticity, so that it can be disregarded for practical purposes. A substantially greater problem is that of the increased pressure build-up at a closed nozzle and the associated increased paint release shortly after opening the nozzle in new marking machines, wherein static pump systems are used for obtaining an even or uniform fixed predetermined application thickness in the driving direction, even at a non-uniform drive speed, wherein the pump systems are driven in a travel dependent manner, for example, by means of a bottom wheel which is in contact with the road surface. The desired characteristics of such systems-namely, that when generating a traffic marker segment the total paint quantity fed to the pump system through the nozzle reaches the road surface, requires additional measures during closing and opening of the nozzle, since the paint flow generated by the pumps and discharging from the nozzle does not by itself come to a stop when closing the nozzle and does not by itself start to flow when opening the nozzle, as is the case in commonly known machines.

The subject invention overcomes the disadvantages of the known road marking machines; extreme pressure peaks during the opening of the nozzle are eliminated and the specific requirements of travel dependent pump systems in new marking machines are taken into consideration.

In particular, it is an object of the invention to totally eliminate any undesirable pressure difference between operating pressure and the pressure at a closed nozzle for all operating pressures or to maintain it at an acceptable level, so as to obtain an optimum uniform paint application.

This object of the invention is obtained in a device of the aforementioned type which includes means for preventing substantial pressure fluctuations with respect to the given system pressure during opening and closing of the applicator nozzle and for controlling or regulating the feeding flow to the nozzle.

The means is preferably a valve which is provided on the pressure side of the pump system in front of the applicator nozzle in a branch outlet, which valve is also coupled to a return line for returning the marking material to a supply container. The valve includes a valve element which closes the branch outlet and which is coupled on its side facing away from the discharge outlet with a spring and a spring bellows or a piston which is in communication with a branch line of the material feeding line leading to the applicator nozzle. The spring bellows or piston is actuable during closing of the applicator nozzle.

The valve element is preferably connected with a load weight or a load spring. The effective discharge face is preferably equal to the effective bellows face. However, the effective bellows face may be larger by a defined dimension than the effective discharge face.

The device for arresting the spring bellows may be a claw and a piston which are actuated together with the closing device for the applicator nozzle.

It is also within the framework of the invention that the valve is replaced in an analogous manner with a friction pair for the actuation of a friction coupling for the pump drive.

The means may also be designed as jointly coupled closing elements for the applicator nozzle and a nozzle on the discharge to the return line, whereby during opening of the one closing element, the other one is closed and conversely. Thereby, the closing elements may also be coupled into one unit. The nozzle at the discharge for the return line should have the same resistance as the applicator nozzle, or a throttle should be provided in the return line which is adjustable to the same resistance as the applicator nozzle. Advantageously, the throughput cross section of the nozzle to be opened should increase by the same amount as the throughput cross section of the nozzle to be closed is reduced.

Other objects and features of the present invention will become apparent from the following detailed description when taken in connection with the accompanying drawings which schematically illustrate several embodiments of the invention. It is to be understood that the drawings are designed for the purpose of illustration only and are not intended as a definition of the limits of the invention.

In the drawings, wherein similar reference characters denote similar elements throughout the several views.

To perform the task of eliminating extreme pressure peaks during the opening of the nozzle and a reduction of the paint flow before the time of closing of the nozzle, the following measures are possible:

1. The starting and the shutting off of the pump during opening or closing of the nozzle 11, respectively. This measure is known. However, a particular difficulty exists—namely, how to synchronize the opening and the closing time of the nozzle to the time of the starting or shutting off of the pump. On the one hand, if the pump is started too early with respect to the time of opening the nozzle, an undesirable pressure peak is obtained. On the other hand, if the pump is started too late, then the required paint discharge is started too slowly from the nozzle, since the time requirement for achieving the desired operating pressure on the nozzle is too large for obtaining an exact traffic lane beginning. Similar difficulties are caused during the closing of the nozzle 11. Expensive control devices would be required in order to adequately resolve these difficulties.

2. The pump is continuously driven and delivers a paint flow in an unchanged magnitude even when the nozzle 11 is closed, whereby this paint stream flows back into the supply container through an excess pressure valve 21. Since at a varying drive speed of the marking machine, the paint flow changes proportional thereto in its magnitude, and thereby the counter pressure generated by the nozzle 11 as well, the reaction pressure of the excess pressure valve 21 must be so adjusted that it covers the highest paint pressure which in the practical application occurs during the paint discharge from the nozzle 11; otherwise, a part of the paint meant for the traffic lane would flow back into the excess pressure valve 21 and into the supply container during application of the paint onto the road surface.

Therefore, at a closed nozzle 11, a paint pressure is generated at a magnitude which, even at an opened excess pressure valve 21, is far above the pressure at an opened nozzle 11 after adjustment. However, this should be avoided for reasons of elastic deformation of the system and the associated previously mentioned consequences.

Figure 1:
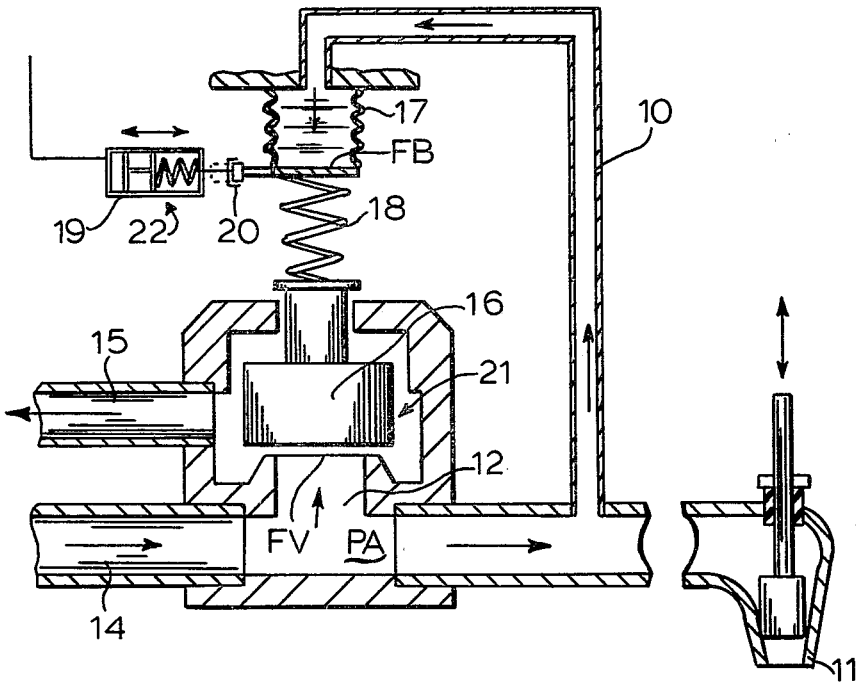
FIG. 1 is a fragmentarily-illustrated sectional view of one embodiment of the inventive device having a spring bellows and a spring-loaded valve element incorporated in a branch discharge line.

In order to keep any undesirable pressure difference between the operating pressure and reaction pressure of the excess pressure valve 21 in all operating steps down to an acceptable magnitude, the reaction pressure of the excess pressure valve 21 must be branched off from the given operating pressure by an automatically operating device. One example for such a solution to the problem is shown in FIG. 1.

The prevailing operating pressure PA during the paint discharge is effective in bellows 17 on face FB which has the same dimension as the cross-sectional face FV of excess pressure valve 21. Bellows 17 acts on a spring 18 and deforms the same. The total force which is active on face FB is transmitted as a spring force to a valve head 16 of the excess pressure valve 21 and it acts as a closing force which corresponds to the operating pressure PA due to its equally dimensioned face. By loading the valve head 16 with a weight, the excess pressure valve 21 does not open during the paint discharge from the nozzle 11, i.e., during the prevailing operating pressure PA in the system. When the nozzle 11 is closed, bellows 17 and thereby spring 18 is simultaneously maintained fixed by an arresting device 22 in the position corresponding to the operating pressure PA, whereby the corresponding closing force on valve head 16 which corresponds to the operating pressure is also maintained fixed. At a closed nozzle 11, the paint pressure in the system increases and lifts valve head 16 of the excess pressure valve 21 at a balanced pressure increase caused by the weight force of the valve head 16. Although the pressure also increases in bellows 17, the total force increase caused by the pressure increase cannot be transmitted as a closing force increase to the valve head 16, due to the arresting of the bellows 17 and of the spring 18.

Due to the magnitude of the weight coupled with the valve head, an acceptable and still tolerable pressure increase at a closed nozzle 11 may be exactly predetermined for any layer thickness fluctuation of the paint application. The pressure difference between the operating pressure at an open nozzle 11 and the reaction pressure of the excess pressure valve at a closed nozzle 11 is contant at all operating pressures, due to the non-variable weight force.

If it is desired that the reaction point of the excess pressure at a closed nozzle 11 always be at a defined ratio with respect to the operating pressure at an open nozzle 11, one can achieve this in a simple manner by adjusting the corresponding ratio of the face FB to the cross-sectional face FV and by removing the weight loading from the valve head 16. The ratio by which face FB is larger than face FV corresponds to the larger dimension by which the reaction response of the excess pressure valve 21 is larger than the operating pressure at an open nozzle 11. Naturally, a combination of both methods is possible.

3. The pump is driven by an overload coupling which, at a closed nozzle 11, reacts after a pressure increase which corresponds to the difference between the operating rotational torque or rotational moment of the coupling at an open nozzle and the through-slipping rotational torque or moment, i.e., slip-through torque. Therefore, at the closed nozzle 11, a paint pressure prevails which corresponds to the difference between the operating rotational torque of the coupling at an open nozzle 11 and the through-slip rotational torque which is larger than the operating pressure at an open nozzle 11.

Since at a varying drive speed of the marking machine, the paint counter pressure generated by the nozzle resistance also changes proportionally to the drive speed, the through-slip rotational torque of the coupling must be so adjusted that it is able to cover the highest operating rotational torques of the coupling which occur during the paint discharge from the nozzle 11 in the practical application. Otherwise, it would not be possible to ensure slip-free operating during the paint application on the road with a strictly travel-dependent paint feeding.

In order to reduce any undesirable or objectionable pressure difference between the operating pressure and the paint pressure which corresponds to the through-slip torque of the coupling to an acceptable magnitude at the different operating speeds which occur at the different high operating pressures, the through-slip rotating torque must be adjusted to the given operating pressure. Similar as described under paragraph 2, it must be the object of such a device to adjust the through-slip rotational torque of the coupling always to a magnitude larger than the operating rotational torque, or even better to adjust it at a predefined ratio so that it is larger than the given operating rotational torque. In principle, the same system as described under paragraph 2 may be used. Thereby, the face FV of FIG. 1 would be replaced by a friction pair and the constant weight force of the valve element 16 from FIG. 1 would be replaced by another constant force (for example, a spring force) which is independent of the operating pressure.

If the through-slip rotational torque should be in a predetermined ratio to the given operating rotational torque, this can be achieved by removing the constant weight force from the valve element 16 and by choosing the corresponding face conditions, as described under paragraph 2. Naturally, the coefficient of the friction pair has to be taken into consideration when designing the coupling and when determining the pressure-loader faces.

A particular design may be obtained in that the drive of the pump is carried out by a hydrostatic device consisting of a hydrostatic pump and a hydrostatic motor, whereby an excess pressure valve 21 takes over the function of the excess load coupling in the cycle of the hydraulic liquid, thus taking care of maintaining the paint pressure in the paint system when the nozzle is closed. Also, with the measures already described under paragraph 2, the reaction pressure of this excess pressure valve 21 in the hydraulic cycle may be branched off from the operating pressure of the paint system, when the nozzle 11 is open.

A stepless, adjustable hydrostatic drive should preferably be chosen for the drive so as to be able to adjust different feeding quantities for the same drive speed of the marking machine corresponding to the different widths and thicknesses of the traffic marker to be applied.

4. A further way to interrupt the paint discharge from the nozzle without lowering the paint pressure at a closed nozzle involves continuously driving the paint pump even while the nozzle 11 is closed and, when closing the nozzle 11 which applies the paint onto the road surface, simultaneously opening another nozzle 23 through which the paint is returned into the supply container. This nozzle 23 must be so dimensioned that it provides the same resistance against the paint flow, i.e., it generates the same paint pressure as the nozzle which applies the paint onto the road surface.

Figure 2:
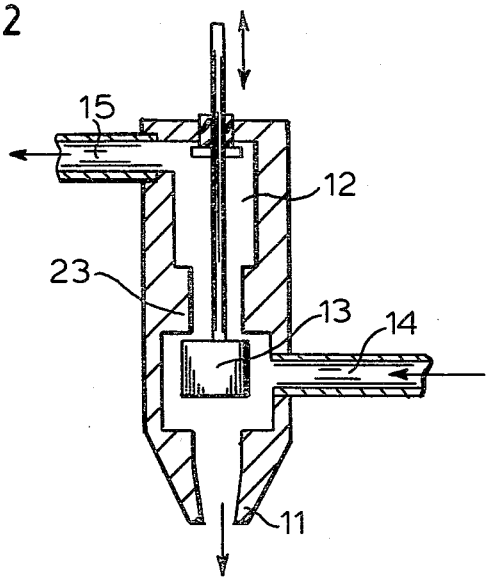
FIG. 2 is a fragmentarily-illustrated sectional view of another embodiment of the inventive device having jointly coupled closing elements.

Advantageously both of the above described nozzles 11 and 23 are combined into one unit so that they can be opened and closed with the same closing element. As can be seen in FIG. 2, the closing element 13 alternately closes nozzles 11 or 23. Nozzle 11 represents the nozzle with which the paint, fed through supply line 14, is applied to the face to be coated, and nozzle 23 is coupled with the return line 15 to the supply container. Simultaneously, when closing nozzle 11 by closing element 13, nozzle 23 is opened and the paint flows back into the supply container. When the geometric conditions are so chosen that, at each intermediary position of the closing element, during the switching-over operation of the closing element 13 into the opposite position, the throughput cross-section of the nozzle to be opened increases by the same amount as the throughput cross section of the nozzle to be closed is reduced, one can even eliminate the pressure pulsation during the switch-over operation.

In a varied form, the possibility described under paragraph 4 may also be used for processing of a rapid reaction, two or multi-component marking material. These are marking materials which consist of two or more components which have to be brought together and mixed shortly before being applied to the road surface and which, only after being brought together and mixed, constitute a marking material which is able to harden. While for a single component marking material, as already described, the applicator nozzle and the nozzle to the return line 15 are operated by the same closing element, i.e., closed and opened (FIG. 2), this is not possible in marking materials consisting of two or more components, because the mixture consisting of two or more components are already reacting and are already in a hardening stage and cannot be returned to the supply container for obvious reasons. Only the individual components may be returned to the supply container before mixing.

Figure 3:
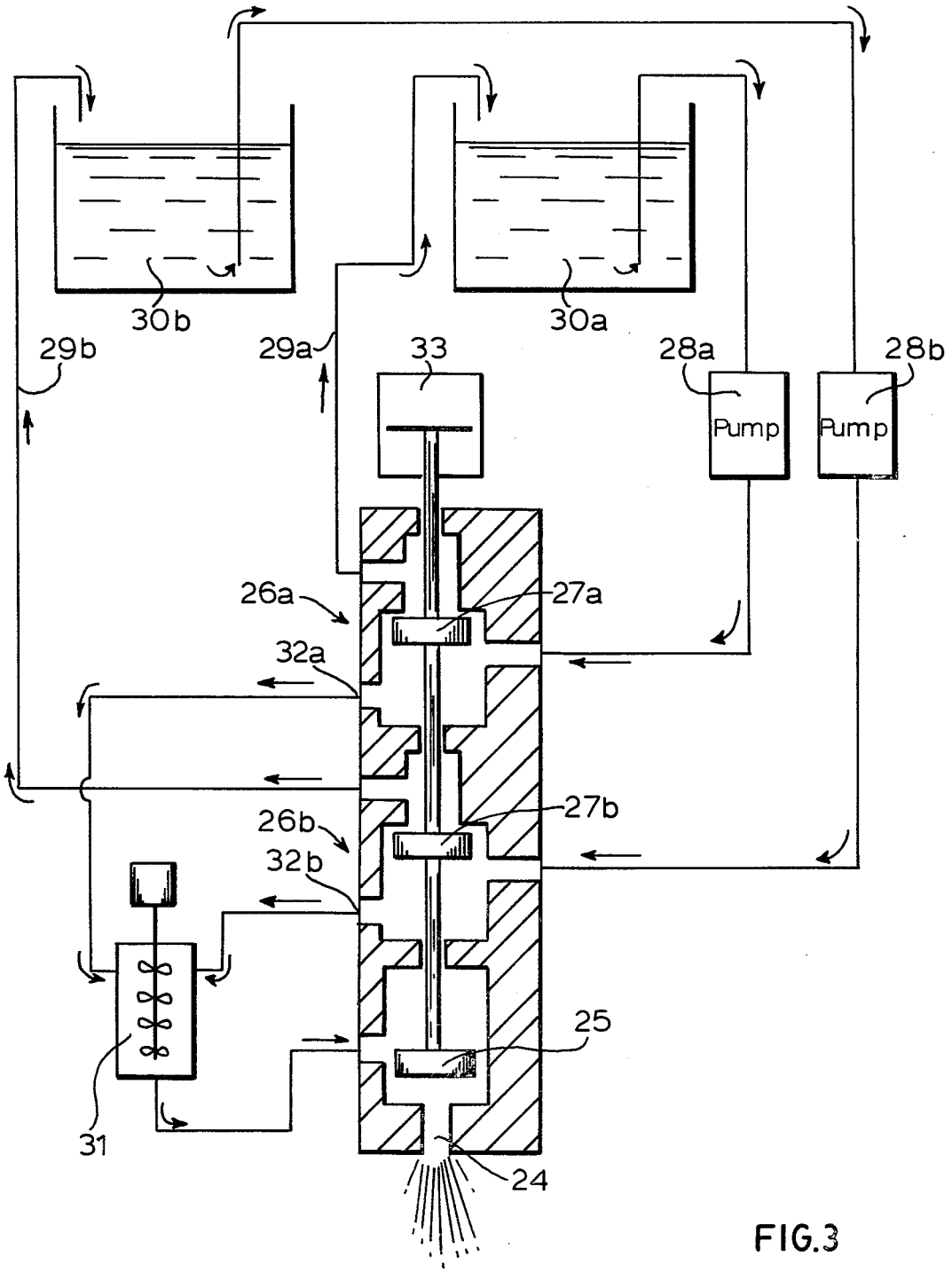
FIG. 3 is a diagrammatic view, in part section, of another embodiment of the inventive device for a multi-component marking material.

In order to meet these requirements a system is proposed as shown in FIG. 3, consisting of an applicator nozzle 24 with an associated closing element 25 and deflection valves 26*a*, 26*b*, etc. for each component. Closing elements 27*a*, 27*b*, etc. are associated wth the deflection valves 26*a*, 26*b*, etc., respectively.

When applicator nozzle 24 is closed by closing element 25, any two-or multi-component mixture cannot be discharged, so that the deflection valves 26*a*, 26*b* must be switched in such a manner that the individual components which are being fed by the individual continuously feeding pumps 28*a*, 28*b* to the deflection valves 26*a* and 26*b*, respectively are returned to the corresponding supply containers 30*a*, 30*b*. Thereby, it is not required that the lines 32*a*, 32*b* leading to the mixer 31 be closed, since these lines are coupled through the mixer with the applicator nozzle 24 and no feeding occurs through these lines while the applicator nozzle 24 is closed.

Advantageously, the deflection valves 26*a*, 26*b*, etc. are activated by the same actuating element 33 which in FIG. 3 is shown as a pneumatic or hydraulic cylinder which also actutes the closing member 25 for the discharge nozzle 24 so as to obtain a simultaneous switching operation for eliminating pressure fluctuations in the feed flows. If the geometric conditions are so chosen that, at each intermediary position of the closing element, during the switch operation of the closing elements 25, 27*a*, 27*b*, into the opposite position, the throughput cross section of the nozzle to be opened increases by the same amount as the throughput cross section of the nozzle to be closed is reduced, one can eliminate pressure fluctuations which would be disadvantageous for the spray characteristics.

Thus, while only several embodiments of the present invention have been shown and described, it will be obvious that many changes and modifications may be made thereunto, without departing from the spirit and scope of the invention.

What is claimed is:

1. A device operable from a travelling vehicle for applying marking material uniformly to a road surface, comprising:

an openable and closable applicator nozzle;

travel-speed dependent driven pump means for feeding marking material under an operating pressure to said applicator nozzle, said pump means including a feed line for feeding marking material under pressure from a supply container to said applicator nozzle:

regulator means for substantially preventing pressure fluctuations relative to said operating pressure during opening of said nozzle, and for controlling the marking material flow to said nozzle, said regulator means including a branch outlet disposed on the pressure side of said pump means upstream of said applicator nozzle;

a return line for returning marking material to a supply container;

a valve interposed between said branch outlet and said return line, and having a movable valve element for opening and closing said branch outlet;

a branch line coupled to said feed line;

a spring coupled to said valve element on the side thereof opposite to said branch outlet;

pressure-responsive spring bellows coupled to said spring and said branch line, said pressure-responsive spring bellows being actuatable during closing of said applicator nozzle;

closing means for closing said applicator nozzle; and arresting means for arresting said spring bellows in a fixed position corresponding to said operating pressure;

said arresting means and said closing means being jointly actuatable;

whereby a closing force corresponding to said operating pressure acts on said valve element upon joint actuation of said arresting means and said closing means, said closing force being insufficient to close off flow of said marking material from said feed line to said return line.

2. The device according to claim 1, wherein said arresting means comprises a claw and a piston.

* * * * *